US005420621A

United States Patent [19]

Richtsmeier et al.

[11] Patent Number: 5,420,621

[45] Date of Patent: May 30, 1995

[54] DOUBLE STAR WHEEL FOR POST-PRINTING MEDIA CONTROL IN INKJET PRINTING

[75] Inventors: Brent W. Richtsmeier, San Diego, Calif.; Todd L. Russell, Camas, Wash.; Stephen B. Witte, Poway, Calif.

[73] Assignee: Hewlett-Packard Company, Palo Alto, Calif.

[21] Appl. No.: 56,036

[22] Filed: Apr. 30, 1993

[51] Int. Cl.[6] ..... B41J 2/00

[52] U.S. Cl. ..... 347/104; 271/10

[58] Field of Search ..... 346/134, 136, 140 R, 346/75; 271/9, 10, 264, 272; 347/16, 104

[56] References Cited

U.S. PATENT DOCUMENTS 5,155,503 10/1992 Tasaki et al. ..... 346/140 R
5,291,244 3/1994 Asano et al. ..... 346/134

FOREIGN PATENT DOCUMENTS 3-240576 10/1991 Japan ..... 346/75
4-126253 4/1992 Japan ..... 346/140 R

*Primary Examiner*—Benjamin R. Fuller
*Assistant Examiner*—John E. Barlow, Jr.
*Attorney, Agent, or Firm*—David S. Romney

[57] ABSTRACT

A pinch wheel is mounted to be spring-loaded against an exit drive roller in close proximity to a print zone, with the pinch wheel formed by a dual starwheel having two spaced-apart sets of teeth for contacting a newly-printed media surface without puncturing or damaging the media.

11 Claims, 5 Drawing Sheets

DOUBLE STAR WHEEL FOR POST-PRINTING MEDIA CONTROL IN INKJET PRINTING

RELATED APPLICATIONS

This application relates to co-pending application U.S. Ser. No. 08/056,639 entitled CARRIAGE SUPPORT FOR COMPUTER DRIVEN PRINTER by inventors Damon Broder, et al. , which application is assigned to the assignee of the present application.

BACKGROUND OF THE INVENTION

The invention relates generally to the field of media control in inkjet printers, and more particularly to post printing media control.

It is important in inkjet printing to provide media control in the vicinity of the print zone in order to hold the media in a proper position while drops of ink are applied by the printhead. In the past, a plurality of large diameter (approximately 12 mm) individual spring-loaded starwheels were used opposite slip/drive exit rollers in order to prevent media buckling en route to an output tray. Such large diameter individual starwheels were used in the Hewlett-Packard PaintJet XL color inkjet printer. Such individual starwheels were reasonably satisfactory for 180 dpi (dots per inch) printheads, so long as the pressure applied by the exit rollers/starwheels to the newly printed media therebetween was rather low, typically less than 0.1 Newtons. However, when higher density 300 dpi printheads were used along with heaters, greater advance accuracy was required of the exit roller. Larger forces were used, creating the risk of the starwheel teeth damaging the newly printed media, particularly when used with exit rollers that acted as tension drive rollers to keep the media taut in the print zone and pull it into the output tray.

BRIEF SUMMARY OF THE INVENTION

Accordingly, it is an object of the invention to provide improved starwheel-type pinch wheels which can handle forces in the range of 0.3 to 0.6 Newtons without damaging newly printed media of various types and which provide adequate postprinting control across the full width of the media.

It is another object of the invention to provide a small diameter starwheel-type pinch wheel to be spring-loaded against a media surface which has been freshly printed by an injet printhead, without damaging the quality of the printed images which could typically be graphics, text, or combinations thereof. A related object is to provide a double starwheel having a hub diameter of approximately 4.5 mm which carries media-engaging peripheral teeth having a diameter of approximately 5.9 mm.

A further object of the invention is to provide a crossbar assembly for carrying a plurality of small diameter starwheel-type pinch wheels which is easy to assemble and which can be carried as a unit with all of the starwheel-type pinch wheels in spring-loaded position.

Still another object of the invention is to provide guide means for directing the newly printed media into contact with the aforementioned starwheels at an optimum angle.

The invention provides for multiple pinch wheel assemblies which each carry a double star wheel for contacting the newly printed surface of media which passes between the double star wheel and a secondary drive roller, with the starwheel perimeters of each pinch wheel assembly having matching diameters and in-phase teeth to assure adequate media control without damaging the newly printed images or puncturing the media. In one embodiment, such double star wheel is a unitary member with a spool-like shape having a hub of approximately 4 mm width which carries twin starwheels, each at an opposite end of the hub.

In a preferred form, the double star wheel is mounted on a pinch wheel assembly which allows relative up-and-down flexing between each of the twin starwheels to allow for variations in the shape and tolerances of the matching exit roller as well as variations in the freshly printed media passing therebetween.

DETAILED DESCRIPTION OF PREFERRED EMBODIMENT AND BEST MODE

Generally speaking, double starwheels of the present invention can be used as a post-printing pinchwheel in various types of printers, but are particularly useful in high density text/graphics color inkjet printers capable of applying relatively large amounts of ink to media advancing through a print zone.

Figure 1:
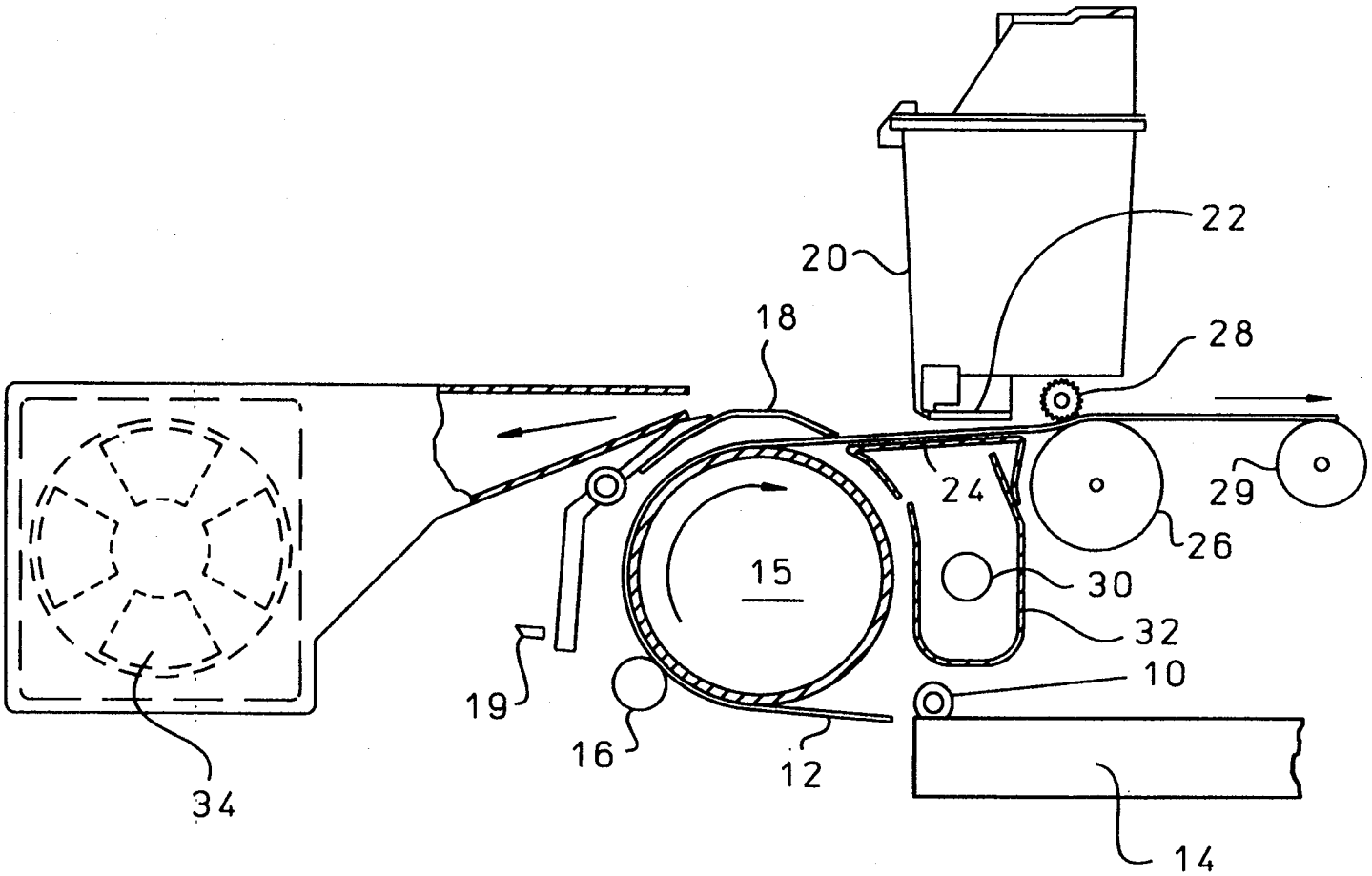
FIG. 1 is a sectional view of an exemplary inkjet printer which schematically shows a media sheet passing through a heated print zone and past a double starwheel of the present invention.

As shown in FIG. 1, an exemplary printer incorporating the present invention includes a pick roller 10 employed to advance a sheet 12 of print media from an input tray 14 into engagement between main drive roller 15 and idler roller 16. Exemplary types of print media include plain paper, coated paper, glossy opaque polyester, and transparent polyester. While the sheet is being advanced, a movable drive plate 18 is lifted by a cam 19 actuated by a printhead carriage. Once the sheet reaches a print zone under a printhead 22 on an ink cartridge 20, the drive plate 18 is dropped, thereby holding the sheet against a screen platen 24 while ink is applied by the printhead. A tension output drive roller 26 and a starwheel-type pinch wheel 28 work in conjunction with the main drive roller 15 to further advance the sheet past a stacking roller 29 into an output tray (not shown). Thus, the tension output drive roller 26 acts as a secondary or auxiliary media driver to assist the main drive roller 15.

In order to achieve satisfactory output of high density printing in a short-time, a heater bulb 30 may be disposed in a reflector 32 under the print zone. An evacuation fan 34 may also be provided to facilitate the drying of ink on the sheet as well as to remove ink vapors from around the print zone.

Figure 2:
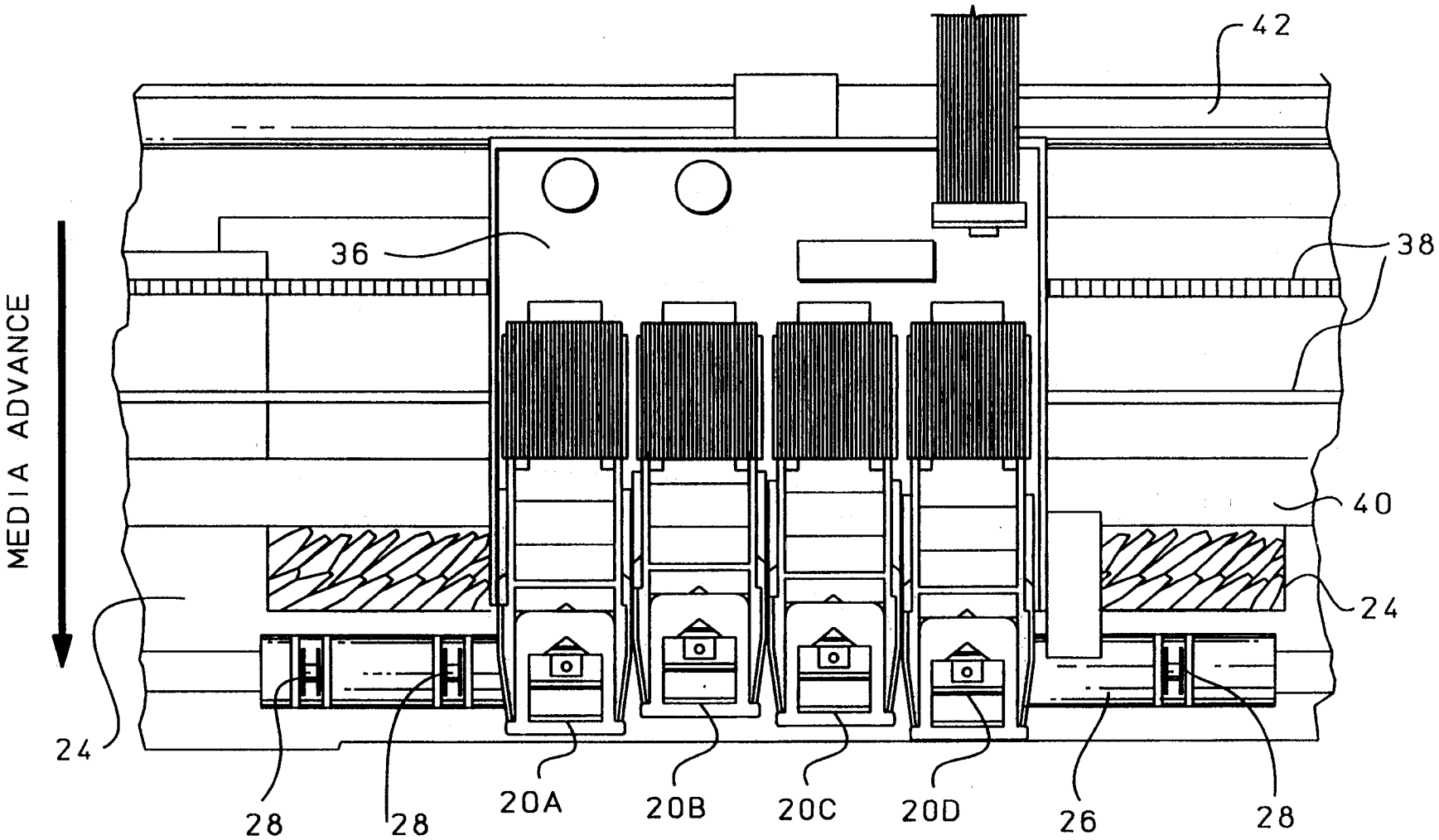
FIG. 2 is a top view of the heated print zone of the color inkjet printer of FIG. 1 showing a carriage carrying four print cartridges, with a plurality of double starwheel assemblies in spaced apart positions across the width of the exit roller.

Referring to FIG. 2, full color printing is achieved by multiple ink cartridges 20A, 20B, 20C and 20D mounted on carriage 36 which is pulled by belt 38 back and forth along front and back slide rods 40, 42 to print successive swaths of text/graphics as the media is advanced through the print zone. The small diameter of the double starwheels 28 allows them to be placed closely adjacent to the print zone without interfering with the back-and-forth traversing of the printheads over the print zone, and without interfering with the minimum spacing between the print nozzles and the media which is desirable for high quality inkjet printing.

Figure 3:
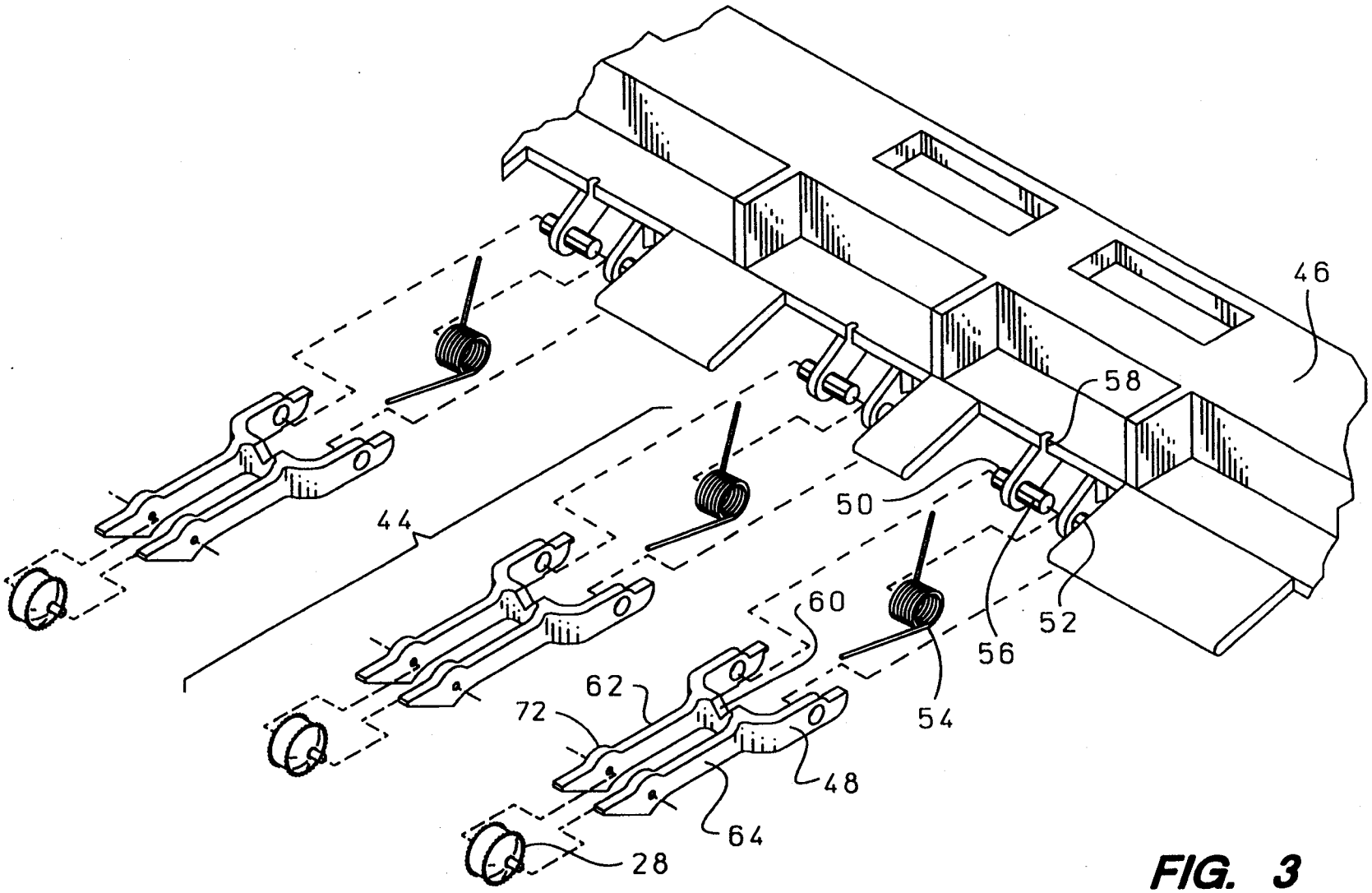
FIG. 3 is an enlarged exploded view showing how each double starwheel assembly is mounted on an exemplary crossbar assembly.

The details of each double starwheel assembly 44 and their mounting on a crossbar 46 is best shown in FIG. 3. The spring-loaded attachment to the crossbar is conventional and includes yoke 48 which mounts on outer pins 50, 52 and spring 54 which mounts on pin 56 with one end for resting in crossbar notch 58 and an opposite end for resting on groove 60 for providing downward spring bias. Unique front arms 62, 64 are connected through one end to yoke 48, but are sufficiently elongated to allow lateral flexing for easy mounting of a double starwheel while at the same time allowing each arm to flex an appreciable distance upwardly/downwardly to assure that teeth on both sides of the hub (i.e.,both on 80 and 82 in FIG. 5) are always in contact with the newly printed media exiting from the print zone, thus spreading the force applied by the double starwheel against the newly printed media surface. This improved design of the mounting arms for the double star wheels 28 assures that each toothed wheel provides good controlling contact with a media sheet without any puncturing or damage, despite uneven or inconsistent media surfaces or imprecision in the tension output drive roller 26.

Figure 4:
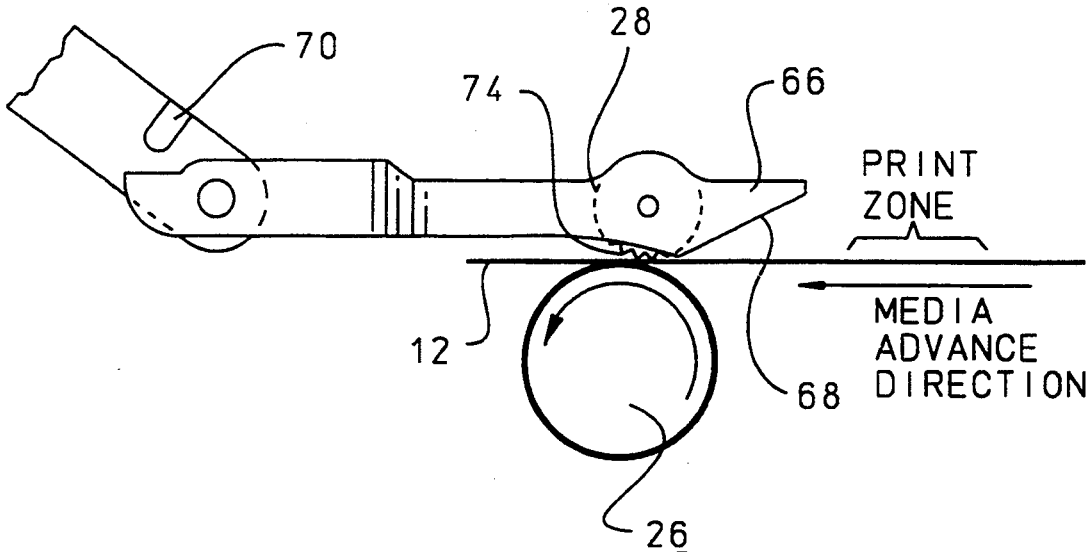
FIG. 4 is a side view showing a double starwheel in spring-loaded contact with media passing through a print zone.

Further details of the unique front arms are shown in FIG. 4, including media guide 66 on each arm, the media guide having a downward beveled surface 68 for guiding a leading edge of media sheet 12 into engagement at a preferred angle with teeth of double starwheel 28. Stop member 70 holds the spring-loaded front arms in a stable position during assembly and before mounting of the crossbar on the printer frame. After mounting and when no media is passing through, the teeth of each double starhweel rest against the underlying tension roller 26 and the stop member is no longer necessary. A raised upper curved edge 72 is shaped to be above the teeth of the double starwheel, so that only a small portion 74 of the teeth are exposed for engagement with media sheet 12.

Figure 5:
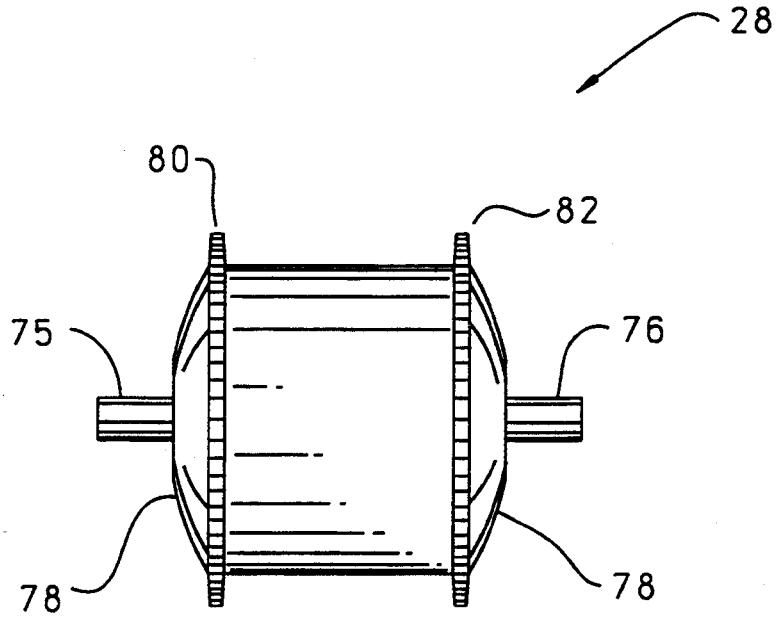
FIG. 5 is an enlarged front view showing a unitary double starwheel of the present invention.

Although the invention may be implemented in various types of double starwheel embodiments, FIG. 5 shows a preferred form which is a unitary machined part made of aluminum material having axial spindles 75, 76 with a diameter of approximately 1 mm for rotatable mounting in matching holes in front arms 62, 64. The double starwheel 28 is sized so that after mounting, the convex sides 78 of approximately 5.6 mm width will fit loosely rather than tightly between the two arms 62, 64 which are spaced apart at approximately 6 mm in order to allow interference-free rotation upon engagement with a sheet of media. Additionally, the teeth 80 are preferably manufactured to be exactly in phase with teeth 82 on the same double starwheel in order to facilitate the even engagement of both sets of teeth 80, 82 at the same time with a sheet of media.

Figure 6:
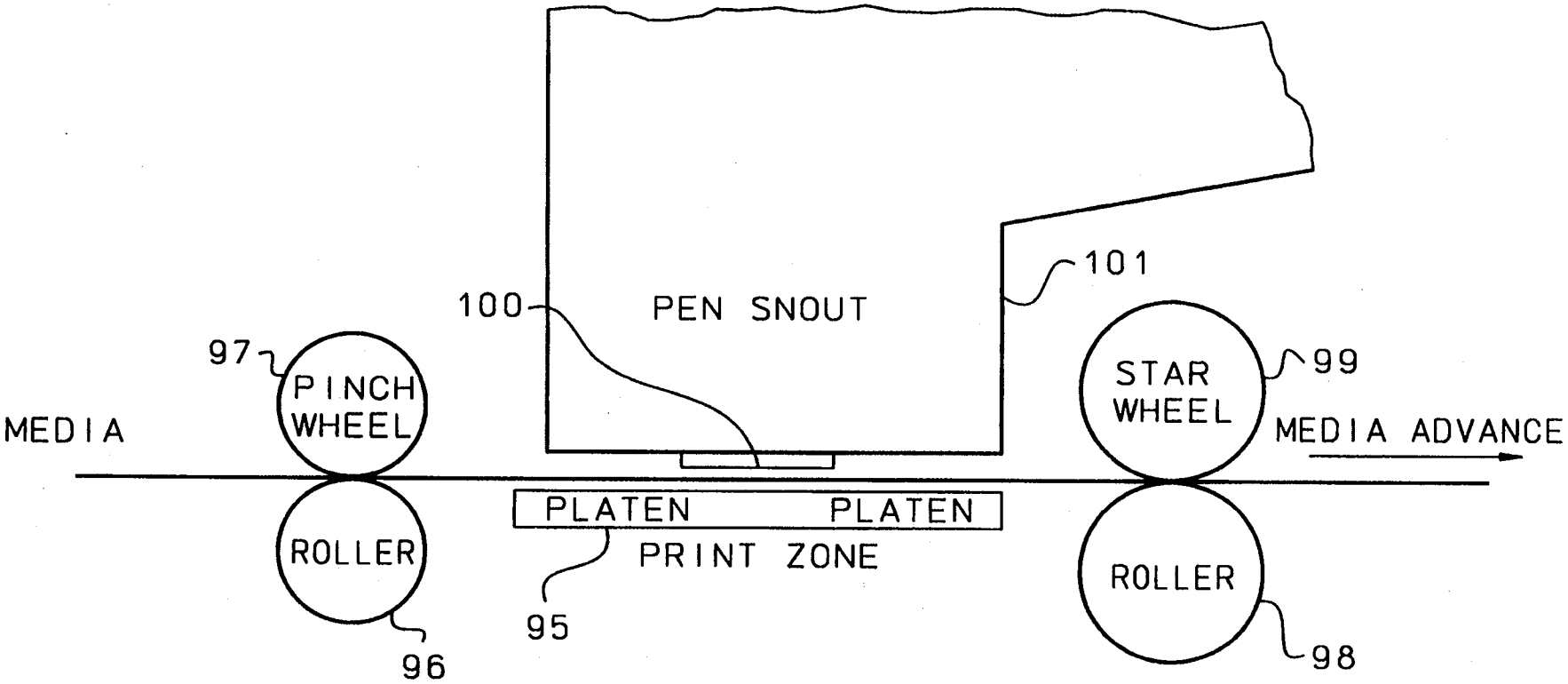
FIG. 6 is a schematic drawing showing the double starwheel of the present invention in close proximity to a print zone of another inkjet printer environment.

The invention has application in different types of printer environments. In that regard, FIG. 6 shows a platen 95 for supporting a sheet of media which passes through primary drive roller 96 and pinchwheel 97 at the entrance to a print zone, and passes through a secondary drive roller 98 and double starwheel 99 at the exit from a print zone. The schematic drawing of FIG. 6 shows that by making all of the foregoing rollers and wheels so that they have a small diameter, the media sheet can be more precisely and securely held in the print zone under a printhead 100 carried on pen snout 101.

While an exemplary embodiment of the invention has been shown and described, it will be understood by those skilled in the art that various changes, modifications and enhancements can be made without departing from the spirit and scope of the invention as defined by the following claims.

We claim:

1. A printer having an ink printhead for applying ink to media passing through a print zone, comprising:

a carriage for holding the ink printhead over the print zone;

drive wheel means for moving the media across the print zone where ink is applied by the printhead to a surface of the media;

idler wheel means for contacting said surface after the ink has been applied thereon, said idler wheel means including two spaced-apart twin starwheels mounted for rotation together as a unit on a common axle to securely hold and position the media as the media leaves the print zone;

an exit drive roller for engaging an underside of the media in opposing relationship to said starwheels; and flexible mounting means for mounting said starwheels for rotation together as a unit on a common axle while allowing at least one of said starwheels to move independently an appreciable distance up-and-down relative to the other of said starwheels to keep both of said starwheels in contact with the media at all times without puncturing or otherwise damaging the media.

2. The printer of claim 1 wherein said drive wheel means constitutes a primary media advance driver, and said driveroiler constitutes an auxiliary media advance driver.

3. The printer of claim 1 which further includes crossbar means for mounting a plurality of said twin starwheels across a media path adjacent to an exit from the print zone.

4. The printer of claim 3 wherein said crossbar means further includes a plurality of spring-loaded arms each pivotally attached to a rigid base for independently mounting each of said plurality of twin starwheels, including a separate spring member applying force directly to said spring-loaded arms.

5. The printer of claim 4 wherein said arms include a media guide for directing the media downwardly into engagement with said plurality of twin starwheels.

6. The printer of claim 4 wherein said crossbar means further includes a stop member for holding said spring-loaded arms in a stable position during assembly of the printer.

7. The printer of claim 1 wherein said two spaced-apart starwheels include teeth of said respective starwheels which are in phase with each other.

8. An improved media control system for a high density printer, wherein the improvement comprises:

an exit pinchwheel for contacting media exiting from a print zone, said exit pinchwheel including at least two spaced-apart twin starwheels mounted for rotation together on a common axle of rotation, each of said starwheels having a set of teeth to engage a surface of the media which has been freshly printed; and mounting means for holding said exit pinchwheel in spring-loaded position against a matching drive roller, said mounting means including a spring member applying spring pressure intermediately between said twin starwheels; and wherein said mounting means flexibly mounts said twin starwheels so that one set of teeth can move independently up-and-down relative to another set of teeth while at the same time still rotating on said common axis of rotation to keep both of said twin starwheels in contact with the media at all times without puncturing or otherwise damaging the media.

9. The media control system of claim 8 wherein said print zone includes a heated print zone and wherein said printer constitutes a liquid ink printer.

10. The media control system of claim 8 wherein said starwheels have virtually identical sized teeth, and wherein said mounting means holds said starwheels in order to position their respective teeth in exact phase alignment.

11. A method of controlling newly printed media as the media exits from a print zone where images have been applied on a printed surface of the media, comprising the steps of:

mounting an exit drive roller and a plurality of exit pinch wheels formed by twin starwheels which are in opposing relationship to the exit drive roller adjacent to the print zone; pulling the media with a drive roller which engages a media surface on the opposite side of the printed surface;

moving the media past the twin starwheels each having two sets of teeth which rotate together on a common axis of rotation;

applying spring pressure intermediately between the twin starwheels to apply controlled force through the twin starwheels against the printed surface of the media; and flexibly mounting said twin starwheels so that one set of teeth can move independently up-and-down relative to another set of teeth while both starwheels are still rotating on the common axis of rotation to keep both of said twin starwheels in contact with the media at all times without puncturing or damaging the media.

* * * * *